US007204845B2

(12) United States Patent
Röhrig

(10) Patent No.: US 7,204,845 B2
(45) Date of Patent: Apr. 17, 2007

(54) CONTAINER FOR STORING A PACIFIER COMPRISING A TEAT AND A PACIFIER SHIELD

(75) Inventor: Peter Röhrig, Vienna (AT)

(73) Assignee: Bamed AG, Wollerau (CH)

( * ) Notice: Subject to any disclaimer, the term of this patent is extended or adjusted under 35 U.S.C. 154(b) by 372 days.

(21) Appl. No.: 10/747,454

(22) Filed: Dec. 29, 2003

(65) Prior Publication Data

US 2004/0178085 A1 Sep. 16, 2004

(30) Foreign Application Priority Data

Jan. 20, 2003 (AT) ..... GM26/2003

(51) Int. Cl.
*A61J 17/00* (2006.01)

(52) U.S. Cl. ..... 606/234

(58) Field of Classification Search ..... 206/205, 206/525; 215/11.6; 220/4.22–4.23; 606/234–236; D24/193–196

See application file for complete search history.

(56) References Cited

U.S. PATENT DOCUMENTS

| | | | | |
|---|---|---|---|---|
| 4,195,638 | A * | 4/1980 | Duckstein | 606/236 |
| 4,329,996 | A * | 5/1982 | Copeland | 606/234 |
| 4,417,613 | A * | 11/1983 | Ryan et al. | 220/4.23 |
| 5,156,617 | A | 10/1992 | Reid | |
| 5,578,058 | A * | 11/1996 | Chen | 606/236 |
| D398,842 | S * | 9/1998 | Rohrig | D9/415 |
| 5,948,003 | A | 9/1999 | Shefflin | |
| 5,964,784 | A * | 10/1999 | Wang | 606/234 |
| 6,638,298 | B1 * | 10/2003 | Shefflin | 606/234 |
| 6,699,264 | B1 * | 3/2004 | Rohrig | 606/234 |

FOREIGN PATENT DOCUMENTS

| | | |
|---|---|---|
| DE | 9702455 | 4/1997 |

* cited by examiner

*Primary Examiner*—Bryon P. Gehman
(74) *Attorney, Agent, or Firm*—Ladas & Parry LLP

(57) ABSTRACT

A container for storing a pacifier including a teat and a pacifier shield, the pacifier being attached to a pacifier strap by a fastening clip, and the container being capable of being fastened or being fastened to the pacifier strap between the fastening clip and the pacifier.

13 Claims, 3 Drawing Sheets

CONTAINER FOR STORING A PACIFIER COMPRISING A TEAT AND A PACIFIER SHIELD

FIELD OF THE INVENTION

The invention relates to a container for storing a pacifier comprising a teat and a pacifier shield, the pacifier being attached to a pacifier strap by means of a fastening clip.

To avoid soiling of the teats of pacifiers which are fastened via a pacifier strap by means of a fastening clip, e.g. to the clothing of a child, various containers for storing the pacifier in the non-used state have become known.

BACKGROUND OF THE INVENTION

From DE 197 02 455 A, e.g., a storage container is known which has two protective covers which are pivotable towards each other and automatically closeable by means of a spring.

In addition, from U.S. Pat. No. 5,948,003 A a pacifier is already known which is fastened to a pacifier strap, a fastening clip being used for covering the teat in the non-used state. What is disadvantageous is that in the non-used state, the pacifier cannot be attached and protected against contaminations at the same time. Moreover, contaminations and dirt particles are transmitted to the teat from the previous fastening site of the fastening clip when accommodating the teat in the clip.

On the other hand, from U.S. Pat. No. 5,156,617 A, a pacifier box comprising a bottom plate and a cover unit which are articulately interconnected has already been known. On the rear side of the bottom plate, moreover, a fastening clip is provided by means of which the box can be fastened to a child's item of clothing. Moreover, the bottom plate has one end of a pacifier strap fastened thereto, on whose other end the pacifier is provided. What is detrimental, however, is that the pacifier box which is directly fastened to the child's clothing can be disturbing for the child and, moreover, opening and closing, respectively, of the pacifier box directly on the child's body is relatively inconvenient. Moreover, the pacifier box shown in U.S. Pat. No. 5,156,617 A is relatively large and bulky.

SUMMARY OF THE INVENTION

Therefore, it is an object of the present invention to provide a container of the initially defined type for storing a pacifier which is more comfortable to handle. In particular, a storage possibility which is structurally simple to produce and comparatively small and is no impediment to the child is to be provided in which the pacifier can be accommodated in a simple manner and likewise removed again.

In a container of the initially defined type, this object is achieved in that the container can be or is fastened to the pacifier strap between the fastening clip and the pacifier. By fastening the container to the pacifier strap between the pacifier and the fastening clip, the container does not directly rest on the child's body, so that the pacifier can be inserted in the container and also removed therefrom again much more easily as compared to the known storage devices. In addition, the container is not simultaneously used as the fastening means so the pacifier and, in particular, the teat, will not get into contact with contaminating matter while it is being inserted in the container.

For a simple fastening of the container on the container strap, it is suitable if the container comprises at least one, preferably two, bracket(s) for guiding the pacifier strap therethrough. Thus, the container can be threaded onto the pacifier strap in the most simple manner and, moreover, can be fixed on the pacifier strap in the most varying positions.

If the container has a teat receiving space which is provided with a passage opening that leads to the outside, wherein, in the stored state, the teat is housed in the container and the pacifier shield is arranged externally of the container, a comparatively small, handy pacifier container is created which, nevertheless, reliably protects the teat from contaminating matter in its non-used state.

As regards a simple construction of the container, it is suitable if pivotably interconnected, substantially alike container halves are provided. The two pivotably interconnected container halves moreover provide a user-friendly storage device which can be opened and closed in a simple manner.

If the two container halves are substantially rectangular in a sectional plane extending parallel to their plane of division, seen in top view, and a pivot axis interconnecting the two housing halves is provided on a shorter side, a container will be created whose rectangular shape, in the longitudinal section substantially corresponds to the elongate shape of the teat, and thus, a small storage device relatively tightly enclosing the teat is created.

To allow for an opening and closing of the container without any problems and to enable an unimpeded guiding of the teat outwards of the container also in the closed state, so that the pacifier shield can be arranged externally of the container, it is advantageous if the passage opening in the closed state is provided on the side opposite the pivot axis, and its size substantially corresponds to the cross-section of the teat where the latter emerges from the pacifier shield.

To retain the pacifier as reliably in the container as possible and to prevent it from unintentionally slipping out of the latter, it is advantageous if in the interior of at least one housing half, at least one web is provided which extends substantially in parallel to the shorter side of the housing half and, in the housed state of the teat, at least partially clamps the teat.

The pacifier will be particularly reliably stored in its container without damaging the teat in the closed position of the container, if in both housing halves at least one web each is provided, the webs extending in parallel to each other, their rims, in the closed state of the container, being spaced from each other.

To facilitate opening of the container, it is advantageous if two gripping projections are provided on the container adjacent the pivot axis, extending substantially in parallel to the pivot axis and enclosing an acute angle with the plane of division of the container, preferably an angle of between 30° and 50°. Thus, the container can simply be opened by pressing the two gripping projections towards each other, and the pacifier can be removed from the container.

If at least one housing half includes at least one latching web that extends beyond the plane of division and engages on the external side of the other housing half in the closed state of the container, an unintentional opening of the container can be prevented.

For a simple, cost-effective production it is advantageous if the entire container is made in one piece of a plastics material, preferably of polypropylene.

BRIEF DESCRIPTION OF THE DRAWINGS

In the following, the invention will be explained in more detail by way of a preferred exemplary embodiment illustrated in the drawing to which, however, it shall not be restricted. In detail.

DESCRIPTION OF ILLUSTRATIVE EMBODIMENTS

Figure 1:
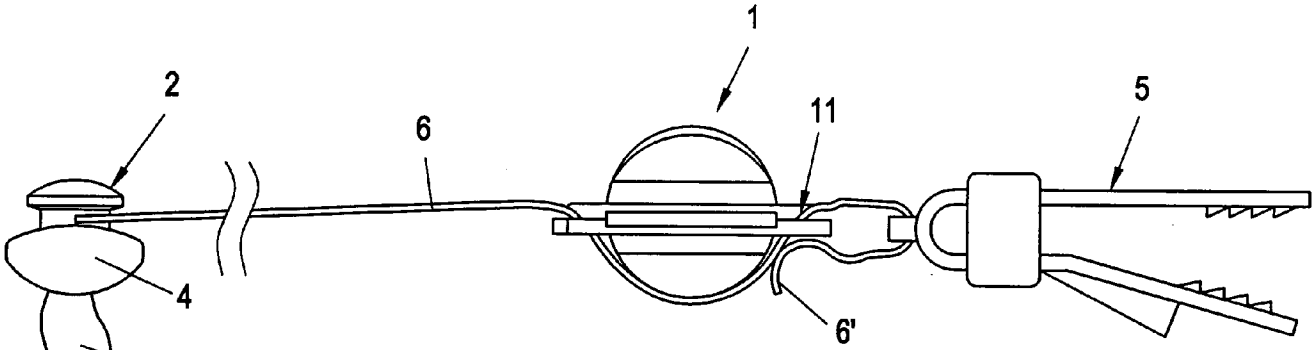
FIG. 1 shows a side view of the container attached to a pacifier strap, wherein the container is arranged between a fastening clip and a pacifier.
Figure 2:
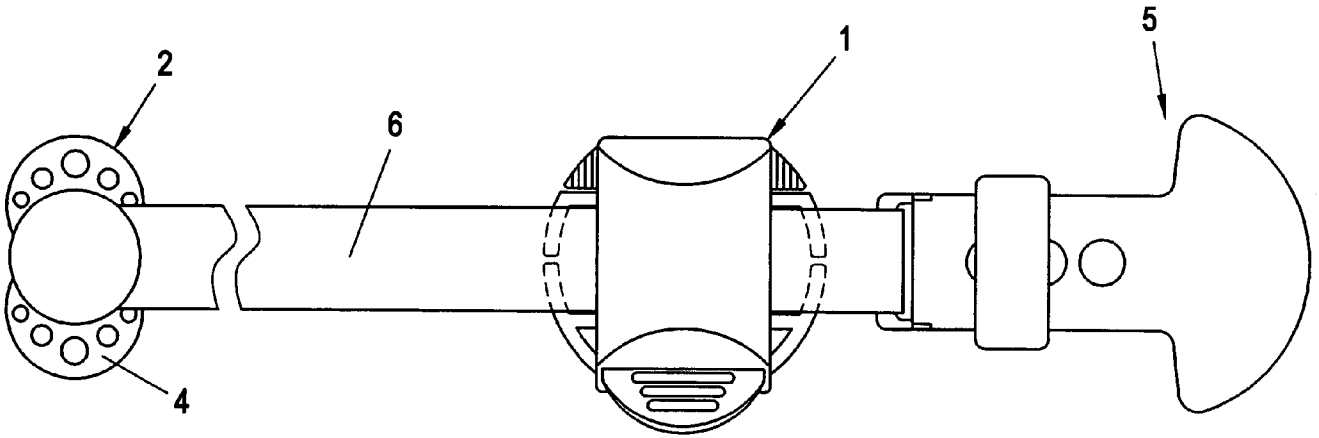
FIG. 2 shows a top view according to FIG. 1.

In FIGS. 1 and 2, a container 1 for storing a pacifier 2 comprising a teat 3 and a pacifier shield 4 can be seen. To fasten the pacifier 2 on an item of a child's clothing, or also on a baby buggy or the like, respectively, a clip 5 is provided which is connected to the pacifier 2 via a pacifier strap 6. In order to keep the teat 3, when it is not in use, from getting unprotected into contact with the environment, e.g. when the child bends down, and to thus prevent soiling of the pacifier while it is not being used, the container 1 for storing the pacifier 2 is mounted on the pacifier strap 6.

Figure 3:
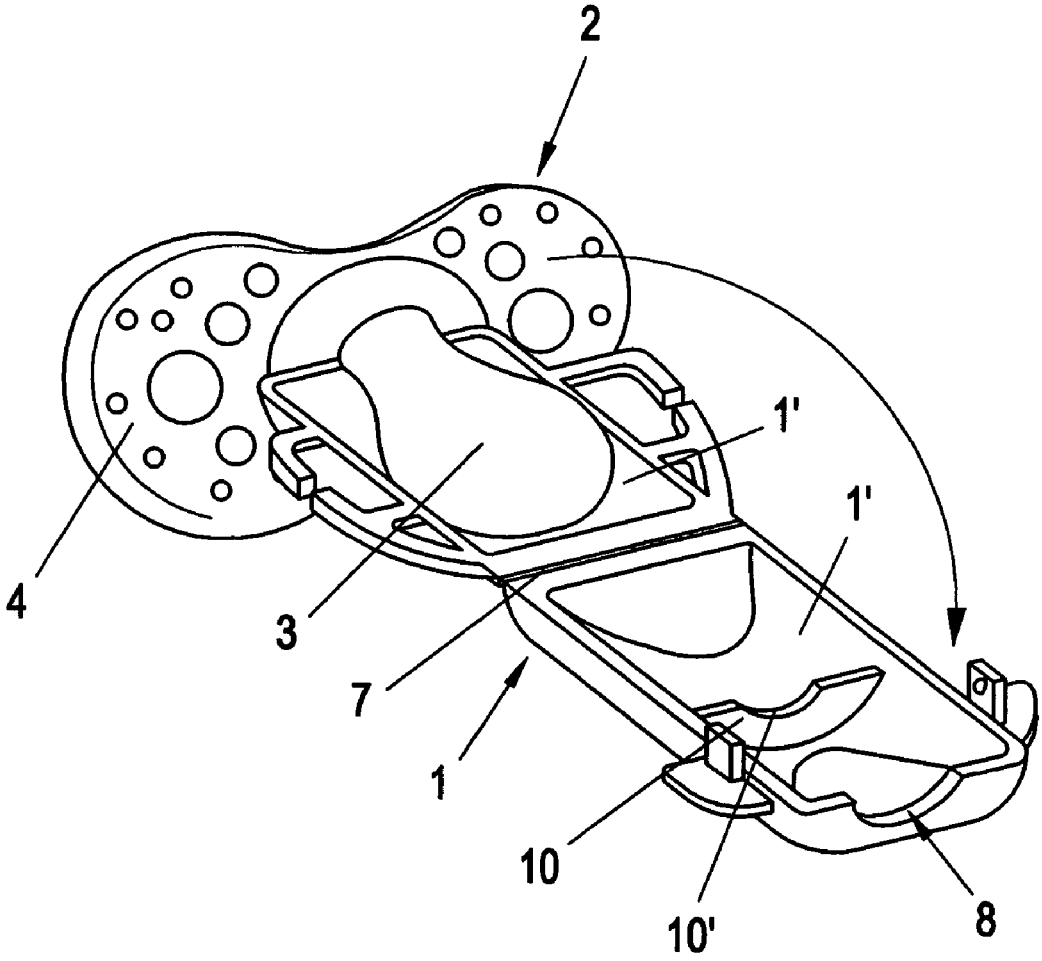
FIG. 3 shows a perspective view of the teat inserted in the container with the container being in its open position.
Figure 4:
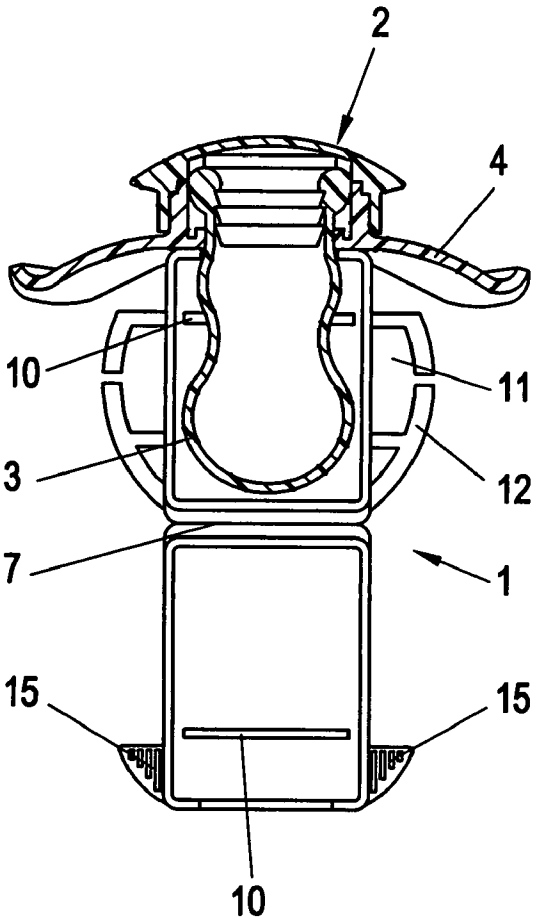
FIG. 4 shows a top view according to FIG. 3.

As is particularly visible in FIGS. 3 and 4, the container 1 is designed to be relatively small and handy, so that merely the teat 3 in its housed state is within the container 1 and thus protected against soiling. The pacifier shield 4, on the other hand, is outside of the substantially cuboid-shaped container 1 when the pacifier 2 is in its housed state.

Figure 5:
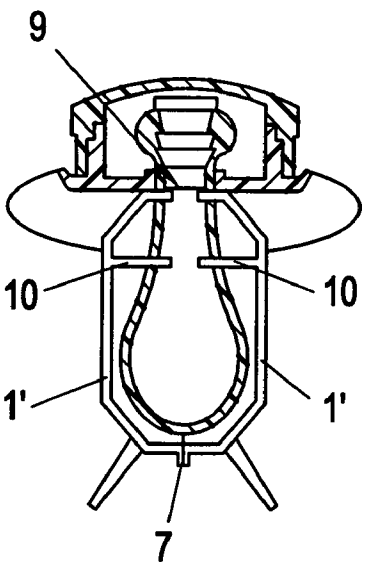
FIG. 5 shows a section of the closed container with the teat housed therein.

For a simple opening and closing of the container 1, the latter is divided into two container halves 1' which are pivotably interconnected via a web 7 which forms a pivot axis. On the side face of the cuboid-shaped container 1 that is opposite the pivot axis 7, a substantially semi-circular recess 8 is provided in each container half 1' by which a passage opening 9 is formed in the closed position shown in FIG. 5, the size of the passage opening 9 corresponding substantially to the cross-section of the teat 3 where it emerges from the pacifier shield 4.

To reliably prevent the teat 3 from unintentionally slipping out of the container 1, webs 10 extending in both container halves 1' in parallel to their shorter sides are provided via which webs 10 the teat 3 is somewhat compressed and clampingly retained in the container 1. To avoid an excessive compression of the teat 3, the rims of the webs 10 in the closed state of the container 1 are spaced from each other and, moreover, the two webs 10 have central recesses 10' through which the distance of the two webs 10 from each other towards their center increases.

For as simple a fastening as possible of the container 1 on the pacifier strap 6, a web 12 each, forming a bracket 11, is provided on one housing half 1' on its longer side, so that the container 1 can be fastened to the pacifier strap simply by threading the pacifier strap 6 through the brackets 11. As is particularly visible in FIG. 1, a displacement of the container 1 along the pacifier strap 6 can be prevented if one pacifier strap end 6' is fastened so as to encompass a bracket 11. However, if a possible displacement along the pacifier strap 6 is desired, also a simple threading thereon is, of course, conceivable.

Figure 6:
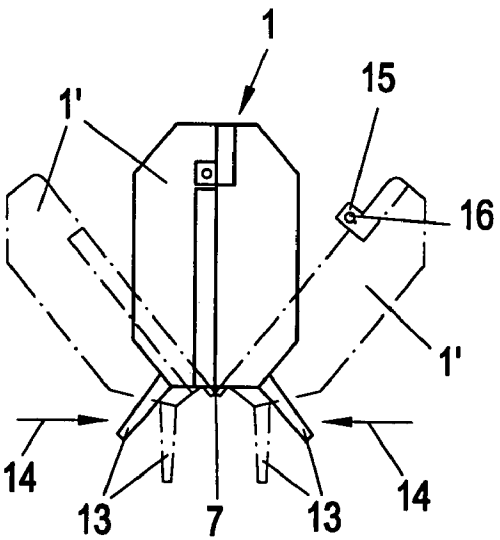
FIG. 6 shows a side view of the container in its pivoted open position as well as in its closed position.

As is particularly visible in FIG. 6, the substantially cuboid-shaped container 1 comprises one grip projection 13 each, adjacent the pivot axis 7 on each container half 1', extending in parallel to the pivot axis 7, so that, as is shown in FIG. 6, the container 1 can be opened in a simple manner by applying pressure in the direction of the arrow 14. A particularly suitable lever action results if the grip projections 14 are arranged under an inclination of substantially 50° relative to the plane of division of the container halves 1' in the closed state.

Furthermore, in FIG. 6 it is visible that one container half 1' has latching webs 15 extending beyond the container rim, which latching webs 15 engage on the external side of the other container half 1' in the closed state of the container 1. Moreover, the latching webs 15 have a latching knob 16 at their inner side that faces the other container half 1', so that an unintentional opening of the container 1 in its closed position will reliably be prevented.

What is claimed is:

1. A device for retaining and storing a pacifier, the device comprising:

a container;

a pacifier strap;

a fastening clip; and at least one bracket for guiding said pacifier strap therethrough in order to directly connect said container to said pacifier strap between a fastening clip retaining end of said strap and a pacifier retaining end of said strap.

2. A device as set forth in claim 1, wherein said container includes two brackets for guiding said pacifier strap therethrough.

3. A device as set forth in claim 1, wherein said container has a teat-receiving space including a passage opening leading towards the outside of the container.

4. A device as set forth in claim 1, said container comprising two pivotably interconnected, substantially identical halves.

5. A device as set forth in claim 4, wherein said two container halves, seen in top view, are substantially rectangular in a sectional plane extending in parallel to their plane of division, having two longer sides and two shorter sides, a pivot axis interconnecting the two container halves being provided on one of said shorter sides of said container.

6. A device as set forth in claim 5, wherein said container has a teat-receiving space including a passage opening leading towards the outside of the container, said passage opening, in a closed state of the container, being provided on a side opposite said pivot axis and having a size substantially corresponding to the cross-section of a teat where said teat emerges from a pacifier shield.

7. A device as set forth in claim 5, wherein inside at least one of said container halves, at least one web extending substantially in parallel to the shorter side of the container half is provided and is sized and configured to at least partially clamp a teat when said teat is housed in said container.

8. A device as set forth in claim 7, wherein at least one web is provided inside each of said two container halves, said webs extending parallel to each other and having rims spaced from each other when said container is in a closed state.

9. A device as set forth in claim 5, further comprising grip projections provided on said container adjacent said pivot axis and extending substantially parallel to said pivot axis, and said grip projections being arranged in an acute angle with said plane of division of said container.

10. A device as set forth in claim 9, wherein said acute angle between said grip projections and said plane of division ranges between 30° and 50°.

11. A device as set forth in claim 4, wherein said container has a plane of division and wherein at least one container half includes at least one latching web, said latching web projecting beyond said plane of division and, when said container is in a closed state, engages externally on said other container half.

12. A device as set forth in claim 1, wherein said container is entirely made in one piece of a plastics material.

13. A device as set forth in claim 12, wherein said plastics material of said container is polypropylene.

* * * * *